US008991133B2

(12) United States Patent
Franklin et al.

(10) Patent No.: US 8,991,133 B2
(45) Date of Patent: Mar. 31, 2015

(54) CONCRETE LUMBER REPLACEMENT

(75) Inventors: Linda J. Franklin, Forest Hill, TX (US); E. Christopher Brooks, Fort Worth, TX (US)

(73) Assignee: Raylate Brooks, Fort Worth, TX (US)

( * ) Notice: Subject to any disclaimer, the term of this patent is extended or adjusted under 35 U.S.C. 154(b) by 0 days.

(21) Appl. No.: 11/603,724

(22) Filed: Nov. 24, 2006

(65) Prior Publication Data

US 2008/0120942 A1 May 29, 2008

(51) Int. Cl.

| | |
|---|---|
| ***E04B 1/00*** | (2006.01) |
| ***E04G 21/00*** | (2006.01) |
| ***E04G 23/00*** | (2006.01) |
| ***B28B 3/02*** | (2006.01) |
| ***B28B 7/00*** | (2006.01) |
| ***B28B 23/00*** | (2006.01) |
| *E04B 1/14* | (2006.01) |
| *E04C 2/38* | (2006.01) |
| *E04B 1/04* | (2006.01) |
| *B28B 7/02* | (2006.01) |

(52) U.S. Cl.

CPC . *B28B 3/022* (2013.01); *E04B 1/14* (2013.01); *E04C 2/384* (2013.01); *E04B 1/04* (2013.01); *B28B 7/0032* (2013.01); *B28B 7/02* (2013.01); *B28B 23/0062* (2013.01)

USPC ..... 52/742.14; 52/414; 52/388; 52/389; 52/676; 52/677

(58) Field of Classification Search

CPC ..... E04B 1/04; E04B 1/14; E04C 2/384

USPC ..... 52/414, 379, 677, 742.14, 745.09, 388, 52/389, 676, 742.1, 742.13

See application file for complete search history.

(56) References Cited

U.S. PATENT DOCUMENTS

| | | | | |
|---|---|---|---|---|
| 5,335,472 | A * | 8/1994 | Phillips | 52/742.14 |
| 5,491,947 | A * | 2/1996 | Kim | 52/426 |
| 5,860,268 | A * | 1/1999 | McWilliams | 52/784.11 |
| 6,041,561 | A * | 3/2000 | LeBlang | 52/234 |
| 6,658,810 | B2 * | 12/2003 | DeLoach, Sr. | 52/701 |
| 7,197,854 | B2 * | 4/2007 | Bettigole et al. | 52/414 |
| 7,278,244 | B1 * | 10/2007 | Rubio | 52/600 |
| 2002/0157336 | A1 * | 10/2002 | Worrell et al. | 52/309.12 |
| 2003/0089065 | A1 * | 5/2003 | Brown | 52/414 |
| 2003/0183742 | A1 * | 10/2003 | DeLoach, Sr. | 249/18 |
| 2004/0118066 | A1 * | 6/2004 | DeLoach, Sr. | 52/414 |
| 2004/0237425 | A1 * | 12/2004 | Worrell et al. | 52/169.9 |
| 2007/0028552 | A1 * | 2/2007 | DeLoach, Sr. | 52/677 |
| 2009/0277127 | A1 * | 11/2009 | Vasquez et al. | 52/741.11 |

* cited by examiner

*Primary Examiner* — Chi Q Nguyen

(57) ABSTRACT

Concrete lumber replacement can be made to exact measurements and cuts. Once placed in the structure, it would make the structure more durable under severe weather conditions. It also deters insects that can destroy the structure over time. Concrete is a fire retardant. If a fire happens, the foundation and frame will still be intact. To date, concrete has never been used in framing. In return, it will conserve trees and lower the overall cost to build the structure.

1 Claim, 4 Drawing Sheets

EXPLODED VIEW

FIGURE 1 EXPLODED VIEW

FIGURE 3 TOP VIEW

CONCRETE LUMBER REPLACEMENT

BACKGROUND OF THE INVENTION

Figure 1:
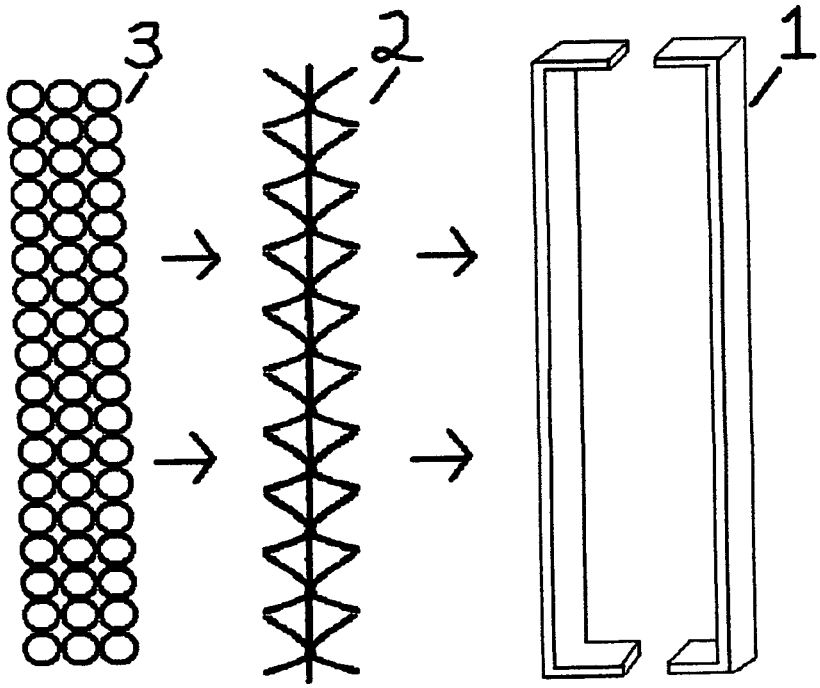

People in the construction industry have always used wood and steel to frame houses and build buildings. Because of its malleability and availability, wood has been the most widely used material, and the majority of homes consist of a wooden frame resting on and bolted to a concrete foundation.

Over time, this wooden frame becomes susceptible to damage from insects, fire, water, and even forces of mother nature like the high winds of a tornado.

In the aftermath of any disaster, whether it's the high winds and floods of Hurricane Katrina or tornadoes in the plains of Kansas, the houses are usually completely obliterated, destroying the wooden frame and leaving only the concrete foundation they was built on.

The costs of repair are astronomical and cities are declared a "state of emergency" until they can be rebuilt.

BRIEF SUMMARY OF THE INVENTION

Concrete Lumber Replacement, a unique and innovative invention, will replace wooden lumber used in the construction of homes and buildings, ultimately saving the environment by cutting back on the number of trees used in wood lumber production, saving money on costly repairs from damage or disaster, and saving lives lost due to structural defects or inadequacies of wood lumber in severe weather such as tornadoes and hurricanes.

Concrete Lumber Replacement is a more durable structure constructed in similar forms as wooden lumber, consisting of metal, rock, and concrete.

It will provide building structures with more security than wood lumber, which has been corruptible to water, fire, pests, and high winds.

An additional benefit of Concrete Lumber Replacement is that it facilitates accurate cutting by a saw, diminishing waste lost on materials like broken wood or saw-dust.

The manner of using the Concrete Lumber Replacement is similar to the use of regular wooden lumber so we allowed flexibility in the construction process of the form to offer variety of options like the ones listed below:

2×4's
2×6's
Dog-eared boards
Picket boards
Circular/Angular boards

The above-mentioned list is just a few designs in the construction of the Concrete Lumber Replacement and other shapes and sizes, long or short, can be constructed based on the mold used to create them; same as with regular wood lumber.

DESCRIPTION OF VIEWS AND DRAWINGS

For this model we use a standard frame mold (1) with dimensions 2"×4"×9', and is constant throughout the illustration. We also made and used pre-cut ⅜" rebar skeletons (2) consisting of two 8'11¾" bars laying parallel two inches apart and twenty-six 3¾" welded in 4" increments along perpendicular along the length of the long bars. We used a standard 3000 psi mix (3) for the interior of the form. One finished solid frame (4) is the view of the completed Concrete Lumber Replacement with only concrete interior and one solid metal frame visible. To show the products real world application we used a standard concrete foundation that uses the 4"×4" metal grounding plates (A). For illustration purposes we use these plates which are usually preset in foundation construction, but they are not a limitation on the use of Concrete Lumber Replacement if plates are not present.

FIG. 1 displays an exploded view of the Concrete Lumber Replacement form in construction phase. Two pieces of the metal frame (1) are laid on a non-stick surface for preparation. One pre-cut rebar skeleton (2) is then inserted between the two metal frames (1) and welded along the interior of the middle of the frames creating space for the concrete mix (3) to fill front and back, and also creating a solid bond. The two metal frames (1) are also welded together at the top and bottom where they meet together. Last, the welded metal frame is filled with the concrete mix (3) and a metal trowel is shaved along the front face to remove excess concrete. The Concrete Lumber Replacement form is then dried over night and cured with a hardening agent to add increased strength.

Figure 2:
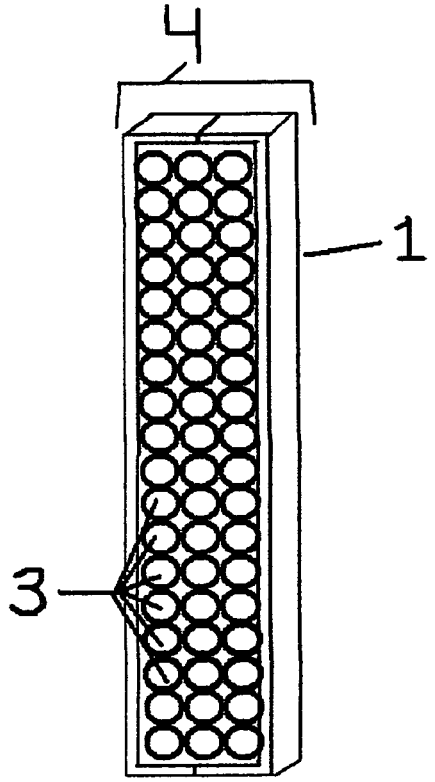

FIG. 2 shows one finished solid frame (4) after it has been constructed and cured over a 24 hour period. This view is the same from the front or back, showing a solid surrounding frame made of two metal frames (1) filled flush with the hardened concrete mix (3).

Figure 3:
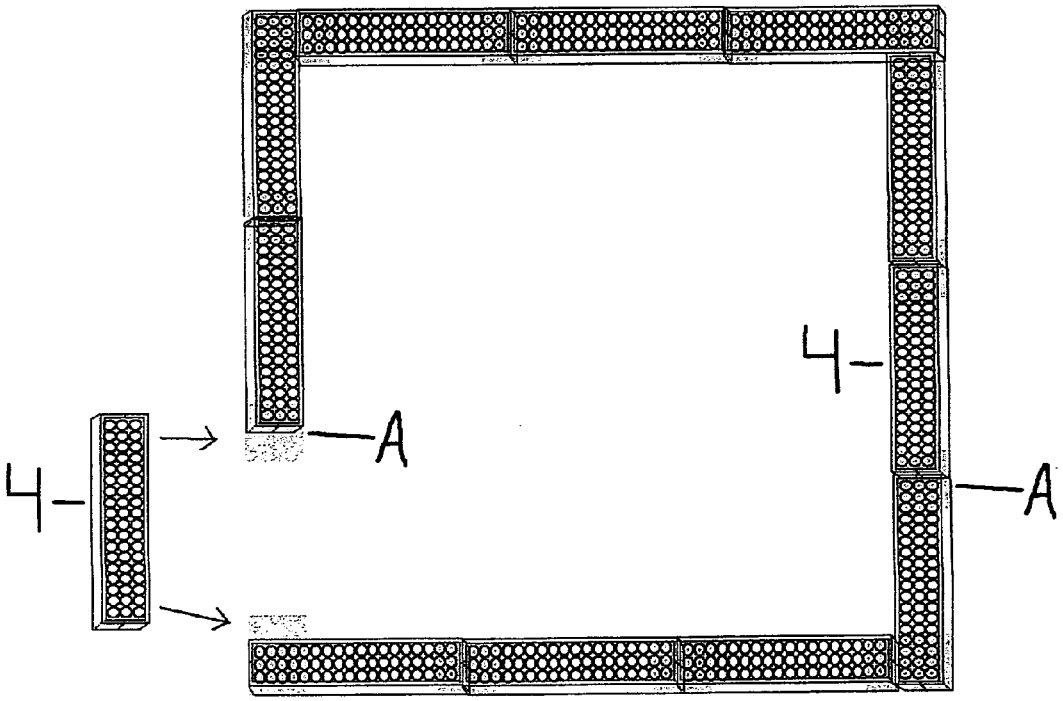

FIG. 3 depicts the top view of a concrete foundation with pre-set metal grounding plates [A] and the installation of a plurality of finished solid frames [4] onto the foundation to form the base of a building frame. Each finished solid frame [4] is laid end to end along the edge of the foundation along the metal grounding plates [A] and welded to each metal contacting point along the plates. The finished solid frames [4] are then welded to each other at each end to end contacting point to create one solid base secured to each other, which is welded securely to the foundation, which is affixed and immovable from the solid earth.

In the case that there is a foundation without pre set metal plates [A], or it has metal bolts protruding from the foundation, Concrete Lumber Replacement can still be installed by drilling two 6" holes every four feet along the interior 4" from the edge of the foundation behind the finished solid frames [4] and drilling in two 8" long pieces of 2" thick rebar into the holes. The finished solid frames [4] can then be welded to the 2 pieces of 2" thick rebar that is protruding 2" above the foundation and sitting flush with the top of the finished solid frame [4] to create the base.

Figure 4:
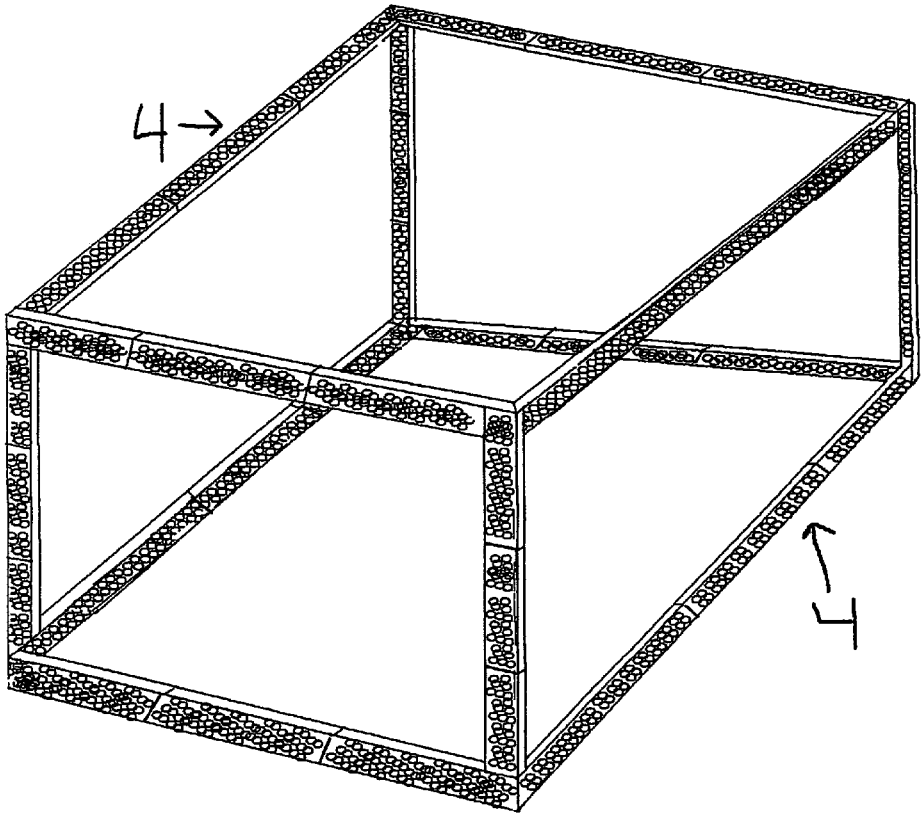

FIG. 4 displays a plurality of finished solid frames [4] affixed in a strong matrix-like frame as to build a structure. The bottom row of frames are affixed to the foundation as shown in FIG. 3 and then each subsequent finished solid frame [4] is then welded one by one into whatever design that meets the specifications of the blueprints. This figure shows a 27'×27' building frame consisting of 36 finished solid frames [4].

DETAILED DESCRIPTION OF INVENTION

Concrete Lumber Replacement is a new and innovative invention that takes the place of regular wooden lumber. It is composed of the solid structures; concrete, rock and metal. When combined, these three materials form an impenetrable solid frame that can be used in the same manner as wooden lumber.

Because of its construction and the materials chosen, Concrete Lumber Replacement is fire retardant and resistant to insect attacks like termite damage. It is also water proof unlike regular wooden lumber that can get soaked by water and warp creating waste from boards that can't be used.

Concrete Lumber Replacement also provides for a safer structure in the event of damage from high winds such as tornadoes or hurricanes on the coast. These natural disasters cause millions of dollars of damage annually leaving houses ripped from the foundation or fallen trees and debris tearing through buildings. The Concrete Lumber Replacement form provides more security as shown in the list below:

- The form is heavier than a standard wooden 2×4 and the extra weight of a plurality of concrete forms makes it more difficult to be uprooted by high winds.
- The form is secured to the foundation by welding to metal plates already affixed to the foundation inside the earth.
- The combined strength of the form makes it less prone to total destruction from high impacts such as flying debris and even collisions such as car crashes.

An additional benefit of the Concrete Lumber Replacement form is that the materials used qualify it as a "Green" product that also saves on electricity usage. Unlike a general all metal prefabricated building that conducts and holds heat in the structure, the concrete on the inside of the form repels the heat being radiated on the house from the outside sun making it cooler in the attic, thus cooler throughout the house saving on energy consumption.

The materials used to make the Concrete Lumber Replacement form can be found readily available and in abundance, making it inexpensive to manufacture.

We claim:

1. A method of manufacturing a concrete lumber replacement member, the method consisting of steps: providing two metal frame members; coupling the two metal frame members together to form a rectangular panel; said coupling the two metal frame members by welds at two short sides of the rectangular panel; attaching a rebar mesh wire member into the rectangular panel; filling the rectangular panel with a concrete aggregate mix material; curing the concrete aggregate mix material; and further providing a hardening agent to strengthen the concrete lumber replacement member.

* * * * *